US009108119B2

(12) United States Patent
McCary, Sr.

(10) Patent No.: US 9,108,119 B2
(45) Date of Patent: Aug. 18, 2015

(54) SECTION RACE TRACK WITH ROLL OVER VEHICLES

(71) Applicant: John Milner McCary, Sr., Birmingham, AL (US)

(72) Inventor: John Milner McCary, Sr., Birmingham, AL (US)

( * ) Notice: Subject to any disclaimer, the term of this patent is extended or adjusted under 35 U.S.C. 154(b) by 75 days.

(21) Appl. No.: 13/815,563

(22) Filed: Mar. 11, 2013

(65) Prior Publication Data

US 2014/0256459 A1 Sep. 11, 2014

(51) Int. Cl.
*A63G 25/00* (2006.01)
*A63K 1/00* (2006.01)
*A63C 7/00* (2006.01)

(52) U.S. Cl.
CPC .. *A63K 1/00* (2013.01); *A63G 25/00* (2013.01)

(58) Field of Classification Search
CPC ..... A63C 7/00; A63G 19/00; A63G 19/20; A63G 21/00; A63G 21/08; A63G 25/00
USPC ..... 472/85–89, 43; 104/53, 60, 77, 78
See application file for complete search history.

(56) References Cited

U.S. PATENT DOCUMENTS

| | | | | |
|---|---|---|---|---|
| 1,231,531 | A * | 6/1917 | Shilling | 293/114 |
| 1,932,031 | A * | 10/1933 | Bellantese | 280/755 |
| 3,810,706 | A * | 5/1974 | Grimm et al. | 404/1 |
| 5,660,595 | A * | 8/1997 | Ferro et al. | 472/92 |
| 7,673,902 | B2 * | 3/2010 | Jayasuriya et al. | 280/755 |

* cited by examiner

*Primary Examiner* — Kien Nguyen

(57) ABSTRACT

The invention entails a modular sectional race track with recreational style racing vehicles, such as four wheel all terrain recreational vehicles. The sectional race course usually has moving obstacles, various obstructions plus the general design of the course track induces the racing vehicles to spin out, tilt over on their side or framework roof and/or rollover completely. The race vehicles have specifically designed roll over frameworks that, with the driver's safety harness fastened, assist the racing vehicles to roll back over on to its drive tires. The racing vehicle may be additionally assisted to roll back over by a driver initiated mechanical righting device. The race tracks' sections can be configured to be sized and shaped for specific race venues. The track sections can be quickly attached, detached and transported as needed.

2 Claims, 2 Drawing Sheets

SECTION RACE TRACK WITH ROLL OVER VEHICLES

BACKGROUND OF THE INVENTION

Motorcycle and four wheel all terrain vehicle (A T V) racing primarily on dirt tracks have gained in spectator popularity in the last twenty to thirty years. These racing events, many now called Motocross racing (Motos), are held in arenas and stadiums with the race course usually developed by shaped and mounded dirt into a closely spaced track with bumps, turns and jumps. In most instances each time a new Motocross race is brought to a new venue, dirt and other material is trucked in, mounded and shaped to form the race course. When the race is over most all the race course forming material is trucked out.

There are many times in Moto racing that the motorcycle, and sometimes the A T V, is thrown or rolled onto its side and the driver usually is separated from the racing vehicle. In most cases the driver can remount the vehicle and continue racing, but a good bit of time is lost, especially in righting the A T V. In many instances assistance by the race course crew is given to right the AN. In Motocross style motorcycle and A T V racing the racers are usually not induced by obstructions or race course controlled moving obstacles to roll over on their side or completely roll over. In most instances if the motorcycle or A T V was to roll completely over while racing, especially with the driver seated on the A T V, then the driver would be so shaken up or hurt, or the racing vehicle would be so damaged, that the racer in many cases would lose significant amount of time or withdraw from the race. Spectators like to see the excitement of a heat of racing A T V's that periodically roll off their drive tires, but can get back up quickly, continue racing and possibly, from behind, win the race.

What is needed is a racing venue that is primarily a modular sectional race course for recreational style vehicles, such as modified all terrain vehicles or A T V's, where the design of the race course track and racing vehicles would give spectators the excitement of watching the modified A T V style racing vehicles having to avoid other racers, dodge moving obstacles and obstructions that induce the modified A T V's to spin out, roll over on their side or roof, and/or roll over completely, and then the racing modified A T V's would roll back on their drive tires and continue racing. The sections of the race track could be reconfigured to be sized, shaped and placed for the racing event space to maximize spectator entertainment.

SUMMARY OF THE INVENTION

The present invention is a modular sectional race course track and racing vehicle to race on the track for spectator entertainment. The vehicles usually racing on the track are modified recreational vehicles, such as four wheel all terrain vehicles (A T V), that have a specially designed roll over framework which enables the A T V to roll back on to its tires, with the driver safety harness fastened and sometimes with driver's leaning assistance, after the racing A T V rolls over on its side or framework roof. In most instances the rolled over A T V will be assisted by the driver assisted roll over mechanical "righting device, which is a mechanism that can protrude out the side of the framework of the modified A T V, which helps roll the A T V back on its drive tires. The modified A T V can usually quickly right itself and continue racing, without much lost time and usually without assistance from the race course crew. The designed layout of the track course, moving mechanical devices such as Bubba Bear, Debbie Deer, Stinky Skunk, etc., which are especially humorous and exciting for children, cause the racing vehicles to spin out, tilt or roll over after veering off from the moving obstacle barricade. Other moving and stationary obstructions such as Rolling Logs or Falling Rock, causes many of the racing vehicles to tilt over on their side, framework roof or completely roll over.

The modular sectional track can be reconfigured to fit the particular space that the racing event is to be held where various sections and components may be added, subtracted or placed to try and maximize the entertainment value for the spectator. The sections and other components of the track can be quickly attached, detached and transported as needed.

DETAILED DESCRIPTION OF THE INVENTION

Figure 1:
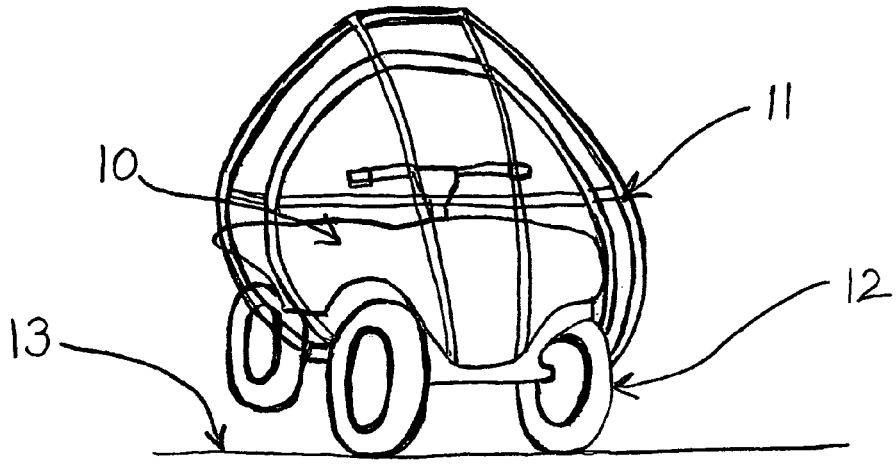
FIG. 1 shows in a side perspective view of a modified all terrain vehicle (A T V) racing vehicle with specially designed roll over framework.

Shown in FIG. 1. in a side perspective view is a modified all terrain racing vehicle 10 with the specially designed roll over framework 11 with a semi-rounded shape. The roll over framework is made of a metal or composite material grid framework surrounding around the side and top of the racing vehicle 10; Shown are the drive tires 12 placed on the track drive surface 13.

Figure 2:
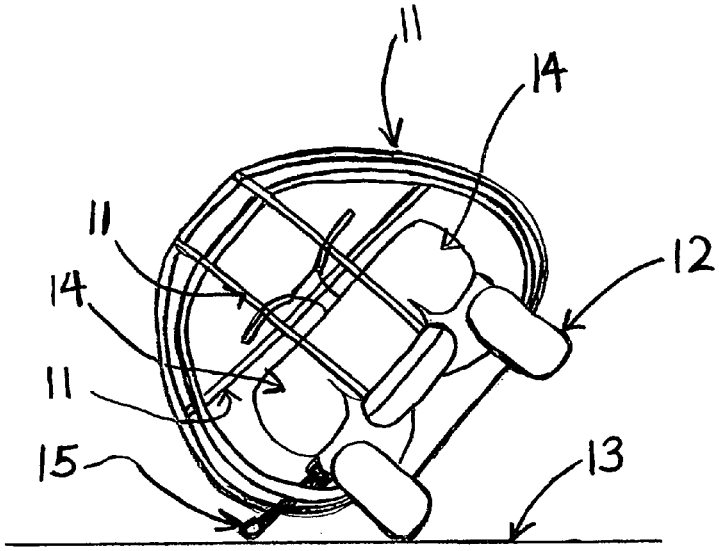
FIG. 2 in a front perspective view shows a tilted over modified A T V racing vehicle with special roll over framework and the driver initiated righting assist mechanism.

FIG. 2. shows in a front perspective view a modified all terrain racing vehicle 14 tilted over on its side. The specially designed roll over framework 11 is also shown with the protruding driver initiated righting assist mechanism 15 that is applying pressure on the track drive surface 13 to push the racing vehicle over, rolling over on the roll over framework, so that the drive tires 12 will engage the track drive surface 13. The driver initiated righting assisting mechanism 15 includes an elongated or protruding rod. When the racing vehicle has rolled over on the racing vehicle's framework, the driver can initiate the rod to extend or protrude through the sides of the racing vehicle so that the distal end of the rod pushing against the ground or racing surface and rotating the racing vehicle back with the drive tires contacting the ground or racing surface.

Figure 3:
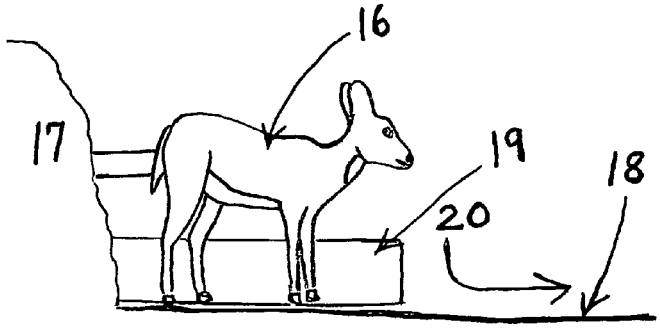
FIG. 3 shows in a front perspective view, an example of a periodic moving obstacle, such as "Debbie Deer."

Shown in FIG. 3. in a front perspective view, one of the movable type obstacles, "Debbie Deer" 16, that shoot out periodically, usually from a hidden position 17, into the race course track 18 to block racing vehicles by the obstacle barricade 19 and cause racing vehicles to veer off quickly 20 and possibly spin out or tilt over.

The invention claimed is:

1. A vehicle racing system comprising:

a. At least one racing vehicle having a roll over framework with a semi-rounded shape, wherein the racing vehicle being similar to all-terrain vehicle (ATV) and having a plurality of drive tires;

b. Said roll over framework made of a metal or composite material grid framework surrounding around the side and top of the racing vehicle; wherein said semi-rounded shape of the roll over framework assists the racing vehicle to roll back over onto the drive tires after the racing vehicle has rolled over onto the roll over framework; and c. A driver initiated righting device includes a roller over righting mechanism having an elongated or protruding rod, wherein when the racing vehicle has rolled on the racing vehicle's framework the driver can initiate said rod to extend or protrude through the sides of the racing vehicle so that the distal end of said extending or protruding rod pushing against the ground or racing surface and rotating the racing vehicle back with the drive tires contacting the ground or racing surface.

2. The vehicle racing system of claim 1 further includes a race course layout that induces the racing vehicle to roll over, said race course layout having highly banked curves and twists, various moving mechanical obstacles, and stationary obstructions.

* * * * *